US008967722B2

(12) United States Patent
Neterer et al.

(10) Patent No.: US 8,967,722 B2
(45) Date of Patent: Mar. 3, 2015

(54) SELF-LEVELING ARMREST ASSEMBLY

(75) Inventors: Alan Neterer, Goshen, IN (US); Ron Dick, Elkhart, IN (US)

(73) Assignee: Norco Industries, Inc., Compton, CA (US)

( * ) Notice: Subject to any disclaimer, the term of this patent is extended or adjusted under 35 U.S.C. 154(b) by 0 days.

(21) Appl. No.: 13/250,091

(22) Filed: Sep. 30, 2011

(65) Prior Publication Data

US 2012/0080918 A1 Apr. 5, 2012

Related U.S. Application Data

(60) Provisional application No. 61/388,994, filed on Oct. 1, 2010.

(51) Int. Cl.
*B60N 2/46* (2006.01)
*A47C 7/54* (2006.01)

(52) U.S. Cl.
CPC ..... *A47C 7/54* (2013.01)
USPC ..... 297/411.32; 297/411.35; 297/411.38; 297/411.39

(58) Field of Classification Search
USPC ..... 297/411.39, 411.35, 411.38, 411.32
See application file for complete search history.

(56) References Cited

U.S. PATENT DOCUMENTS

| | | | | |
|---|---|---|---|---|
| 4,098,478 | A | 7/1978 | Spitzke | |
| 4,968,095 | A * | 11/1990 | Moyer | 297/411.39 |
| 4,974,987 | A | 12/1990 | Smock | |
| 5,658,047 | A | 8/1997 | Ratza et al. | |
| 6,089,669 | A | 7/2000 | Wilcox et al. | |
| 6,176,459 | B1 | 1/2001 | Wilcox et al. | |
| 6,361,114 | B1 * | 3/2002 | Rumler | 297/411.39 |
| 6,510,635 | B1 | 1/2003 | Rudolph et al. | |
| 6,715,836 | B1 * | 4/2004 | Chen et al. | 297/411.39 |
| 7,862,123 | B2 * | 1/2011 | Baker et al. | 297/411.33 |
| 8,328,286 | B2 * | 12/2012 | Steury et al. | 297/411.39 |
| 2007/0120408 | A1 * | 5/2007 | Hsieh | 297/411.39 |

* cited by examiner

*Primary Examiner* — David R Dunn
*Assistant Examiner* — Alexander Harrison
(74) *Attorney, Agent, or Firm* — Hahn Loeser & Parks, LLP

(57) ABSTRACT

In one aspect, the subject embodiments are directed to a seat that includes a seat bottom and a seat back, wherein the seat back is pivotable with respect to the seat bottom about one or more pivots. A linkage assembly is employed that is coupled to each of the one or more pivots. The linkage assembly includes a linking component that has a first location mounted to the seat bottom and a second location mounted to the seat back. A cam is coupled to the seat back location, wherein a dowel is permanently affixed to the cam. An end distal from the cam, a pin extends perpendicularly from the dowel and is angled at between 20 and 70 degrees upward from a plane formed by an arm channel.

19 Claims, 11 Drawing Sheets

SELF-LEVELING ARMREST ASSEMBLY

BACKGROUND

In conventional assemblies, seats are designed to provide a level of comfort to a user by allowing a certain degree of reclination of a seat back relative to a base. To provide further comfort, the seat can include armrests which allow a user to place his or her arms thereon. Many prior art designs, however, do not provide adapt the armrests when the seat is placed in a reclined position. Instead, the armrests can maintain substantially a perpendicular disposition relative to the seat back wherein the user's arms are pointed upward in awkward position thereby causing discomfort In order to overcome this shortcoming, self-leveling armrests have been employed for use with reclining seats. These self-leveling deigns allow the armrest to remain substantially parallel to the seat base regardless of the position of the seat back. Conventional self-leveling armrest designs, however, suffer from complex designs and resulting exorbitant costs. Accordingly, such prior art designs are impractical for use in the market place as the cost is too great. Moreover, these designs integrate the self-leveling armrest completely with the frame of the seat thereby forcing a manufacturer to build entire seat assembly to provide any variance in armrest features. Moreover, the manufacturer is forced to sell a single model which is incapable of modification or modularity. As a result, a customer or end user is unable to choose from one or more custom solutions.

In view of the above deficiencies, seat assemblies are needed that can accommodate modular armrest designs.

SUMMARY OF THE INVENTION

In one aspect, the subject embodiments are directed to a seat that includes a seat bottom and a seat back, wherein the seat back is pivotable with respect to the seat bottom about one or more pivots. A linkage assembly is employed that is coupled to each of the one or more pivots. The linkage assembly includes a linking component that has a first location mounted to the seat bottom and a second location mounted to the seat back. A cam is coupled to the seat back location, wherein a dowel is permanently affixed to the cam. An end distal from the cam, a pin extends perpendicularly from the dowel and is angled at between 20 and 70 degrees upward from a plane formed by an arm channel.

DETAILED DESCRIPTION

The subject invention is utilized to provide an armrest on a seat which is self leveling. In this manner, the armrest can maintain a position that is substantially parallel to the plane of a seat. The subject self-leveling arm assembly can be employed, in one embodiment, as a modular add-on to an existing structure. As a result, a manufacturer can easily provide a plurality of seat models, wherein each model offers particular desired features.

Figure 1:
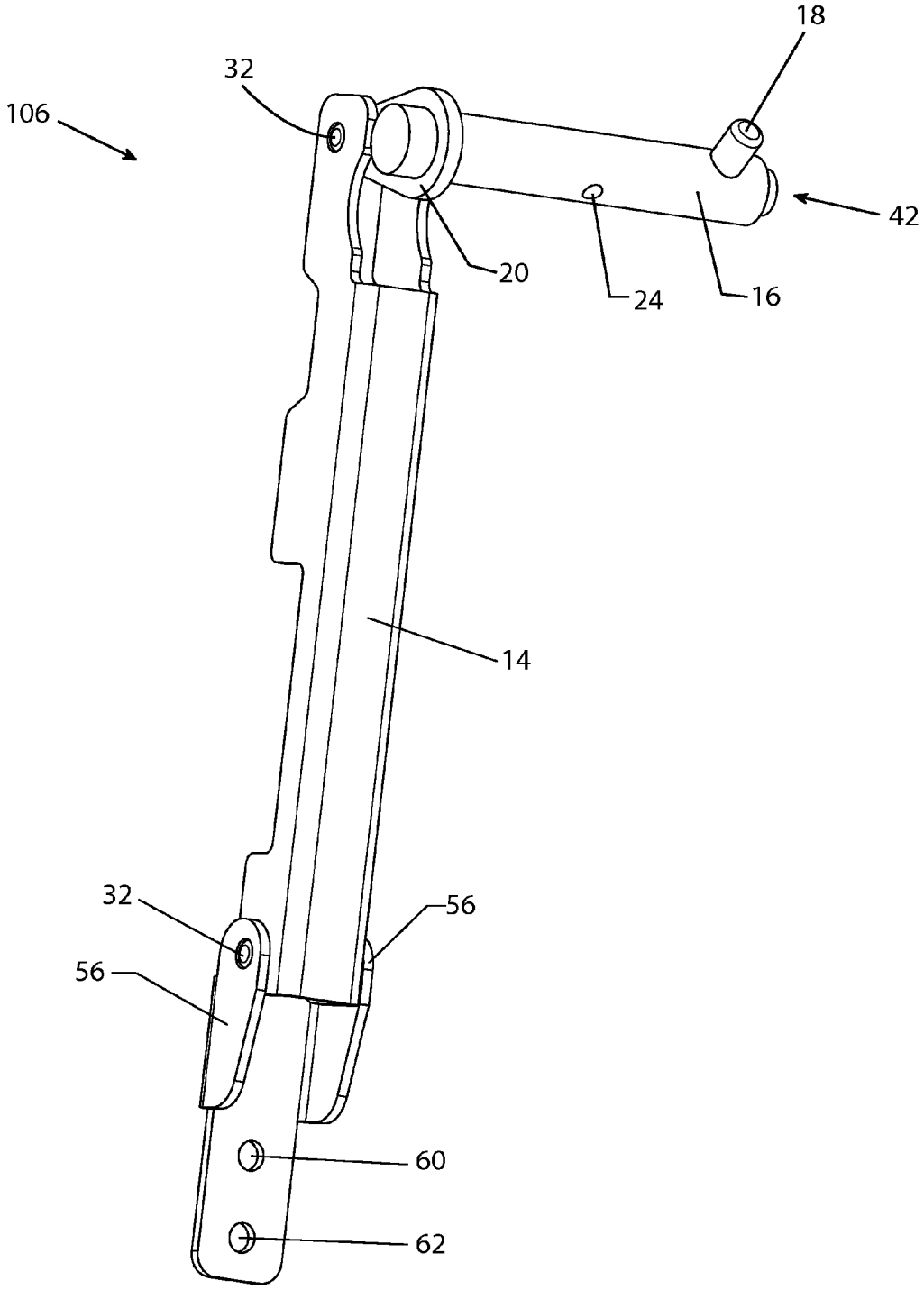
FIG. 1 is a perspective view of a self-leveling linkage assembly.

FIG. 1 is a perspective view of a self-leveling arm assembly 106. The assembly 106 is comprised of a main link 14 coupled to a lower bracket 12 and a dowel subassembly 42. Each of the lower bracket 12 and the subassembly 42 are coupled to the main link 14 via securement components. In one example, the securement components are pin 30 and pin 32 which are each inserted into a through-hole to facilitate rotation of the corresponding component. In this manner, the pin 30 creates a pivot between the main link 14 and the lower bracket 12. Similarly, the pin 32 creates a pivot between the main link 14 and the dowel subassembly 42.

The dowel subassembly 42 is comprised of a dowel 16 which is coupled to a cam 20. The cam 20 is in turn coupled to the main link 14 via the pin 32 in a rotatable fashion as described above. In one embodiment, the dowel 16 is welded to the cam 20 to permanently affix the dowel 16 and prevent rotation thereof. A pin 18 is mounted substantially perpendicular to the main axis of the dowel 16 on a side distal from the cam 20. As the dowel 16 is permanently affixed to the cam 20, the location of the pin will also maintain a particular rotational angle. In one aspect, the location of the pin 18 is specified relative to the plane of the base and/or armrest. The pin 18 can have an angle of between 0.1 and 90 degrees to facilitate self leveling of an arm channel (not shown) affixed to the self-leveling arm assembly 106 via the dowel subassembly 42. In another embodiment, the pin 18 can be press fit into the dowel 16 in order to secure the pin. In addition, the dowel 16 further comprises a hole 24 that can accommodate a pin (not shown) to prevent movement of the assembly 106 relative to a seat frame The lower bracket 12 includes four holes to accommodate securement components. Two holes 56 and 58 accommodate the pin 30 to couple the lower bracket 12 to the main link 14. In addition, holes 60 and 62 are utilized to accommodate fastening devices (not shown) to mount the self-leveling arm assembly 106 to the base of a seat frame.

Figure 2:
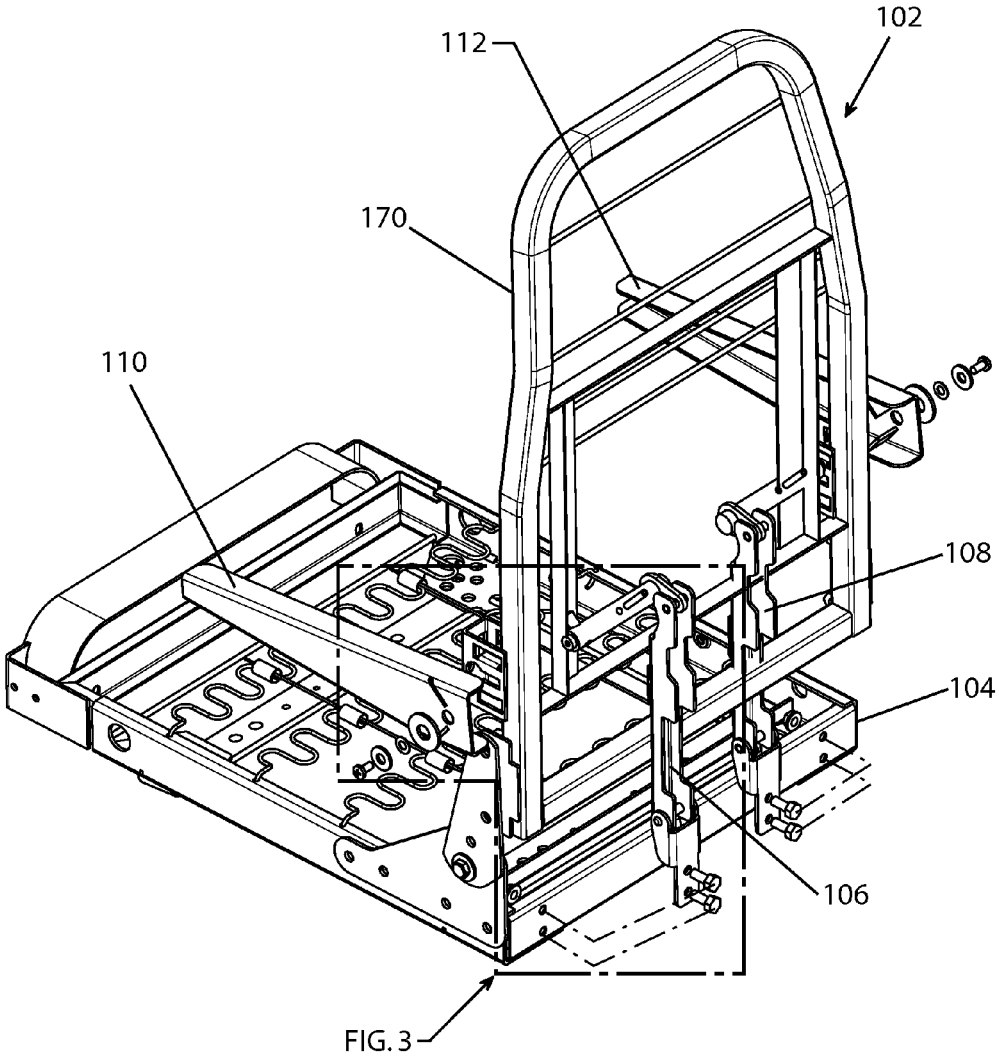
FIG. 2 is a perspective view of the self-leveling linkage assembly in association with a seat frame and provides an exploded of an arm channel configured to be disposed thereon.

FIG. 2 illustrates the self-leveling arm assembly 106 employed with a seat frame 100. In this embodiment, the self-leveling arm assembly is shown in both a left hand and right hand configuration to accommodate respective left arm channel and right arm channels of the seat frame 100. The seat frame 100 contains a back frame 102, a base frame 104, a left hand self-leveling arm assembly 106, and a right hand self-leveling arm assembly 108. A left arm channel 110 is coupled to the back frame 102 via the left hand self-leveling arm assembly 106. A right arm channel 112 is coupled to the back frame 102 via the right hand self-leveling arm assembly 108.

Figure 3:
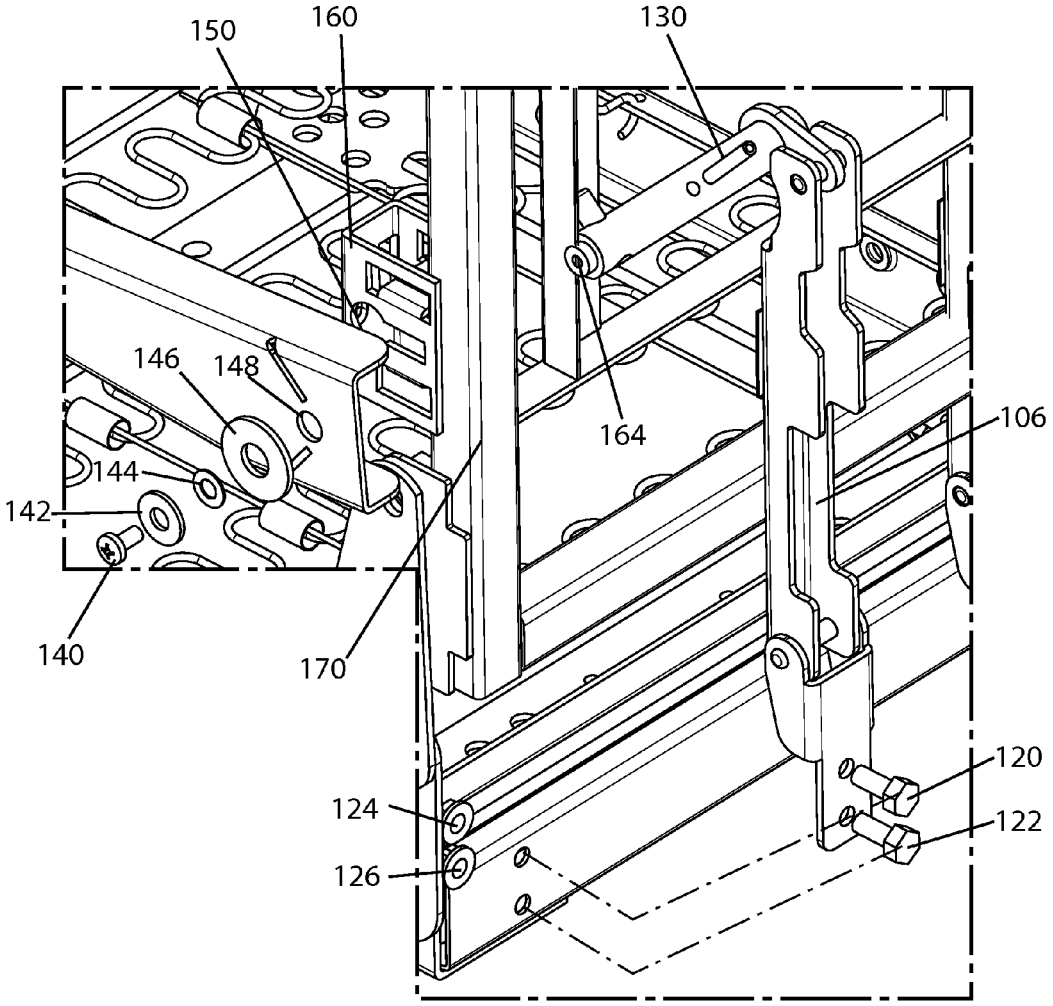
FIG. 3 is a detail view of a portion of FIG. 2.

FIG. 3 is a detail view of FIG. 2 showing the left-hand self-leveling arm assembly 106 coupled to the seat frame 100. It is to be appreciated, however, that the right hand self-leveling arm assembly is coupled to the seat frame symmetrically to the seat frame 100 as described herein. Fastening devices 120 and 122 are disposed in holes 60 and 62 respectively. In one embodiment, the fastening devices 120 and 122 are bolts, which are threaded and coupled to nuts 124 and 126 to secure the lower bracket 12 to the seat frame 100. Similarly, a fastening device 140 is utilized to secure the dowel subassembly 42 to the seat frame via a bracket 160. The bracket 160 is mounted to a support 170 of the back frame 102 via any known method. In this manner, the bracket 160 can be introduced at substantially any point in the assembly process during manufacture of the seat frame 100. The bracket 160 includes a keyhole 150 that allows the dowel subassembly to be inserted therein. The keyhole 150 contains a rectangular portion coupled directly to a circular portion, wherein the circular portion is substantially the same size as the diameter of the dowel 16. The rectangular portion allows the pin 18 to be inserted therethrough.

Once the dowel subassembly is inserted through the bracket 160, the fastening device 140 can be used to couple the dowel subassembly 42 to the bracket 160 and to the arm 110. To facilitate appropriate tension of the fastening device 140, washers 142 and 146 and a spacer 144 can be employed. In one aspect, the spacer 144 is made of a nylon or equivalent material. The washers 142 and 146 and the spacer 144 can allow minimal friction upon rotation of the arm channel 110 around a pivot point 148. In one aspect, the fastening device 140 is a screw which is driven into a threaded hole 164 at the end of the dowel 16. Once the dowel subassembly 42 is inserted through the bracket and coupled to the arm through the bracket 160 and coupled to the arm 110, a pin 130 can be inserted to prevent movement of the arm 100 and the arm and the pin 18 toward the interior of the seat frame 100.

Figure 4A:
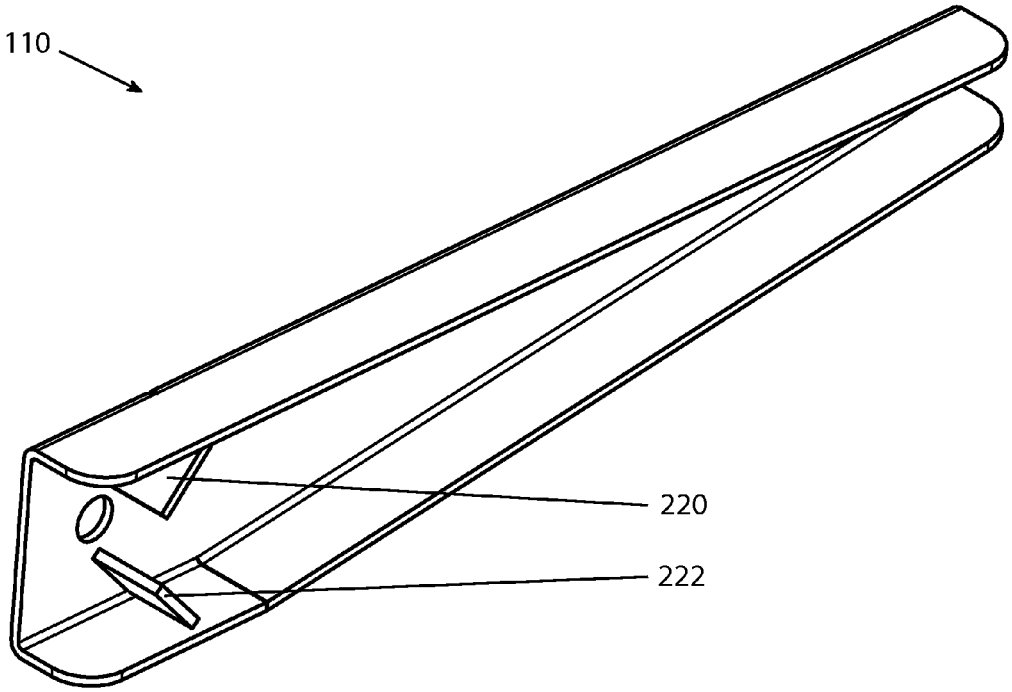
FIG. 4A is a perspective view of an arm channel bracket that is utilized with the self-leveling arm assembly.
Figure 4B:
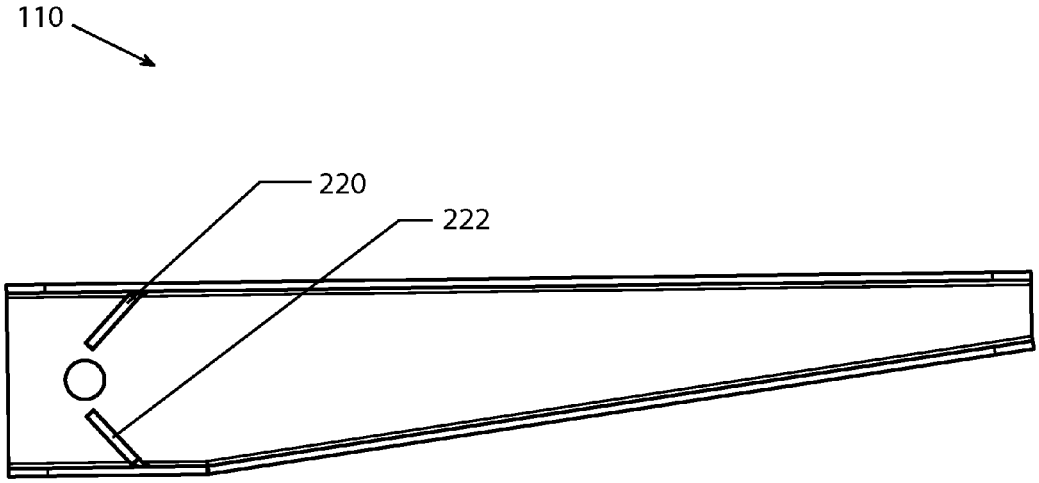
FIG. 4B is an elevation view of an arm channel bracket that is utilized with the self-leveling arm assembly.

FIGS. 4A and 4B illustrate the arm 110 in greater detail. The arm 110 includes an arm channel stopper 200 which is utilized to engage with the pin 18 coupled to the dowel 16 to allow rotational movement of the arm 110 commensurate with the angle of recline of the back frame 102 in relation to the base frame 104 of the seat 100. The stopper 200 is comprised of an upper stopper element 220 and a lower stopper element 222 which are disposed at particular angles relative to the dowel 16 inserted through the hole disposed therebetween. In one embodiment, the upper stopper element 220 and the lower stopper element 222 are disposed at substantially 90 degrees from each other, wherein the upper stopper element and lower stopper element are approximately 45 degrees rotated from the datum 234. In operation, the upper stopper element 220 rests on top of the pin 18 of the dowel subassembly 42. The arm 100 can be lifted up parallel to the back frame 102 wherein the lower stopper element 222 will stop the rotation of the arm 100 as it engages the pin 118. In this manner, a passenger can be afforded access into and out of the seat by moving the arm 110 out of the way. The arm rest can be subsequently placed downward and remain substantially parallel to the seat base regardless of the angle of reclination between the back frame 102.

Figure 5:
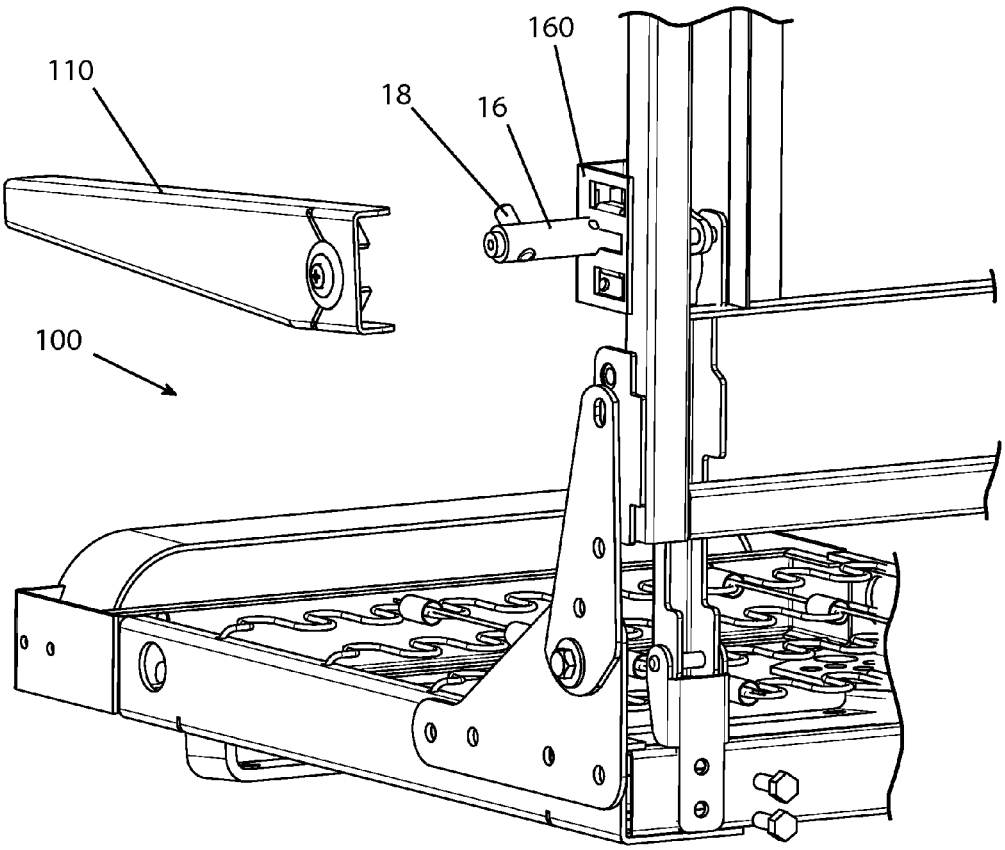
FIG. 5 is a perspective view of the self-leveling linkage assembly in association with a seat frame and provides an exploded of an arm channel configured to be disposed thereon.
Figure 6:
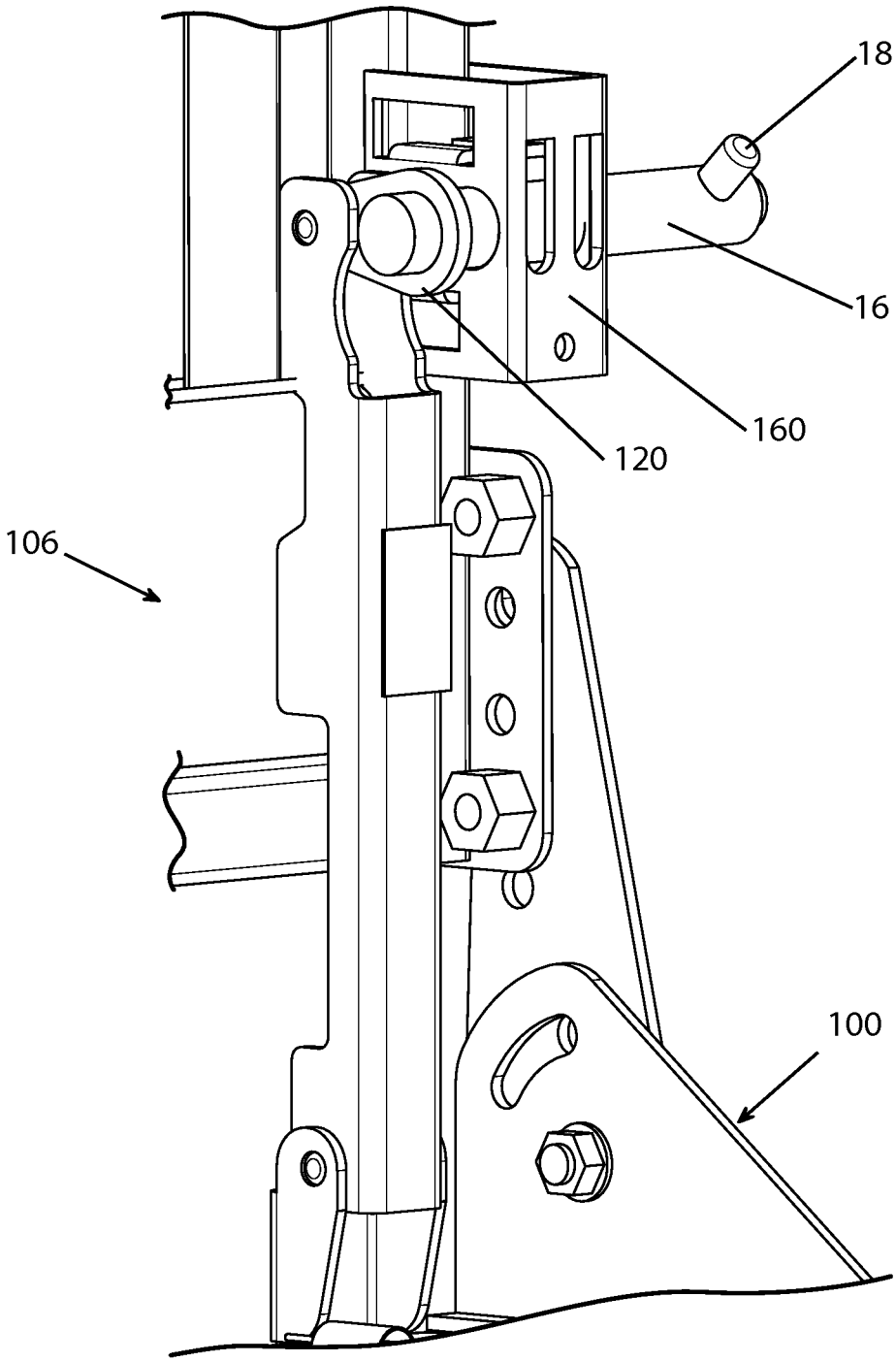
FIG. 6 illustrates the self-leveling linkage assembly after installation onto a seat frame.

FIG. 5 shows an exploded view the left hand self-leveling arm assembly 106 after it has been secured to the base frame 104 via the fastening device 120 and 122. The left 110 is exploded showing the fastening device 140 employed to couple it to the seat frame 100. As illustrated, the pin 18 is located at an angle of around 45 degrees although it is contemplated that the rotational location of the pin can be anywhere from 0.1 to 90 degrees in relation to the plane of the base frame 104 and/or the arm channel 110. FIG. 6 is a front view showing the left hand self-leveling arm assembly 106 after it is installed onto the seat frame 100. As shown, the bracket 160 is introduced to facilitate the coupling of the self-leveling arm assembly 106 to the seat 100.

Figure 7:
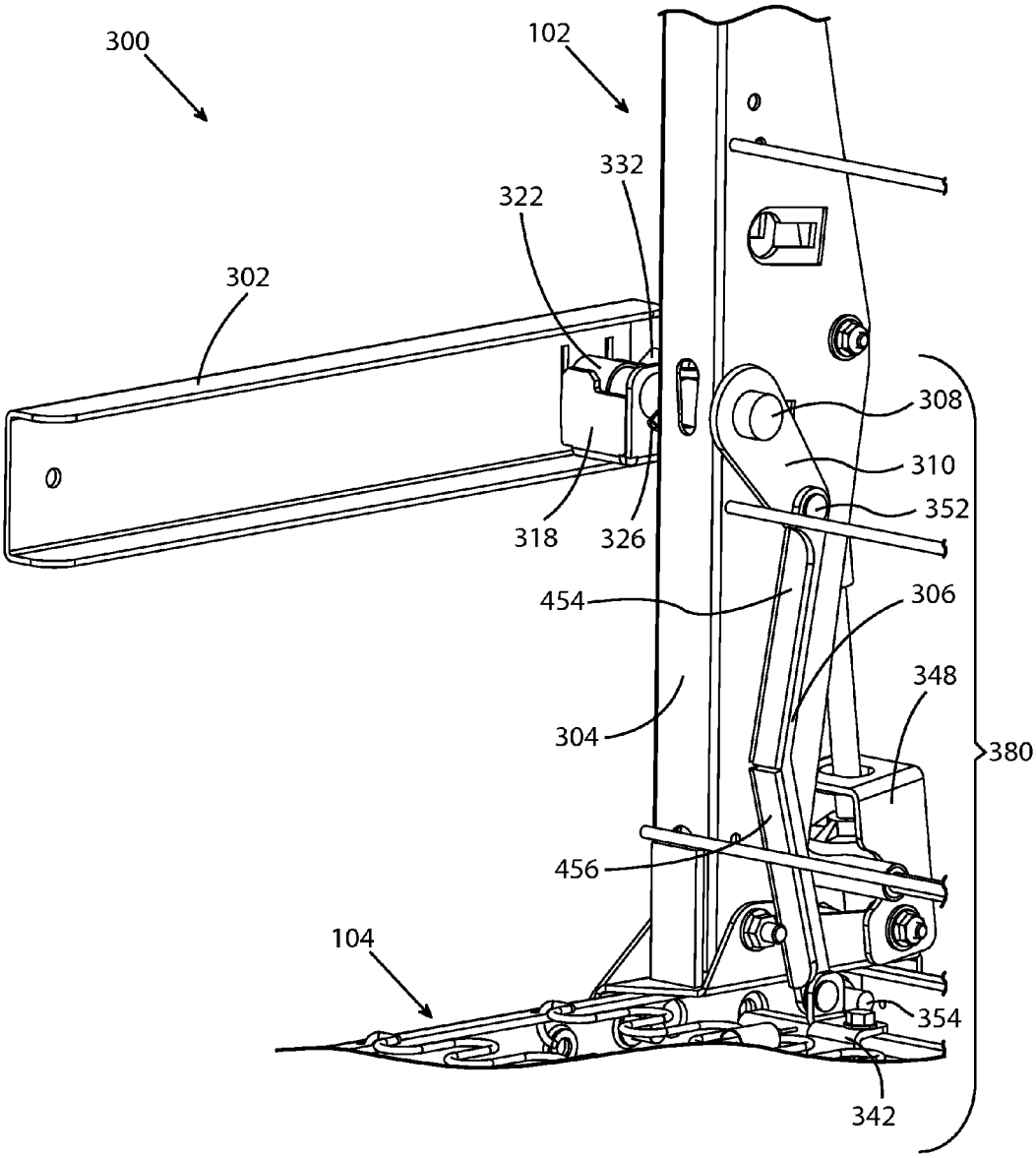
FIG. 7 is a front perspective view of a self-leveling arm rest system that is installed on a seat frame.

FIG. 7 is a front perspective view of an embodiment 300 of the self-leveling arm system that includes an arm channel 302 that is coupled to a base frame 104 via a linkage system 380. The linkage system 380 includes a tube collar 322 that is fixably secured to the arm channel 302 to accept a first end of a dowel 308, which is seated therein proximate to the arm channel. A second end of the dowel 308 is fixably secured to a cam 310 whereby the rotation of the dowel 308 initiated by rotational movement of the arm channel 302 results in rotation of the cam 310 in either a clockwise or counter-clockwise direction commensurate with an up or down rotation of the arm channel 302. Alternatively, the movement of the back frame 102 relative to the base frame 104 (e.g., caused by reclination of the user) can pull on the linkage assembly 380 thereby pulling the cam downwardly toward the front of the seat. This movement of the cam will cause the dowel 308 to rotate thereby rotating the arm channel 302 to remain substantially parallel with the base frame 104.

A rigid arm 306 has a first end and a second end, wherein the first end is pivotally secured to the cam via rivet 352 or other suitable fastening device. The second end of the rigid arm 306 is pivotally secured to the base frame 104 via a bracket 342. Pivotal securement is facilitated via rivet 354 or other suitable device to interface the rigid arm 306 with the bracket 342. The bracket 342 in turn is permanently fixed to the base frame 104 utilizing one or more fastening devices, such as a nut, a bolt, a rivet, etc.

In order to provide support for the linkage system, a rear frame upright 304 can be employed to dispose the dowel 308 there-through. In one example, the rear frame upright is disposed between the cam 310 and the tube collar 322, although substantially any arrangement is contemplated within the scope of the subject embodiments. Placing the dowel 308 through the rear frame upright 304 provides additional structural support to the linkage system 380 and facilitates stable and consistent rotational motion of the arm channel 302 relative to the base frame 104. Additional structure support may be realized via the use of a bracket 318 is mounted onto the arm channel 302 and substantially surrounds the tube collar, as illustrated. The bracket 318 can contain an aperture (not shown in FIG. 7) to accommodate the dowel 308 to pass there-through for seating within the tube collar 322. A pin 326 can be placed within the dowel to mitigate lateral motion of the dowel 308.

A bolt 332 can be disposed within the dowel 308 orthogonally to the longitudinal access of the dowel 308. When the arm channel 302 is rotated, the bolt 332 can make contact with a forward stop 328 within the bracket 318 to prevent further rotational motion of the arm channel 302. Similarly, a rear stop (not shown in FIG. 7) can be employed to prevent rotational motion in the opposite direction beyond a certain range. In an alternate embodiment, as shown in FIG. 8, the tube collar 322 can have a slot 338 cut, wherein the bolt 332 is employed to secure the dowel to the tube collar and to limit rotational motion of the dowel 308 and arm channel 302.

In order to provide a self-leveling function, the linkage system 380 is designed to allow the arm channel 302 to remain substantially parallel to the base frame 104 regardless of the position of reclination of a user within the seat 300. As the rear frame 102 of the seat 300 is reclined (e.g., displaced away from the forward edge of the arm channel), the arm 306 pushes forward thereby rotating the cam 310 accordingly to modify the longitudinal position of the arm channel 302. This motion is facilitated by the pivotal securement of 352 and 354 in two locations at the cam 310 and at the seat base frame 104. In an embodiment, the arm 306 is angled wherein a first element 454 and a second element 456 are disposed at an obtuse angle relative to one another. This slight break in the rigid arm 306 can facilitate a greater range of motion for the arm upon user reclination and can provide added strength to the structure.

Figure 8:
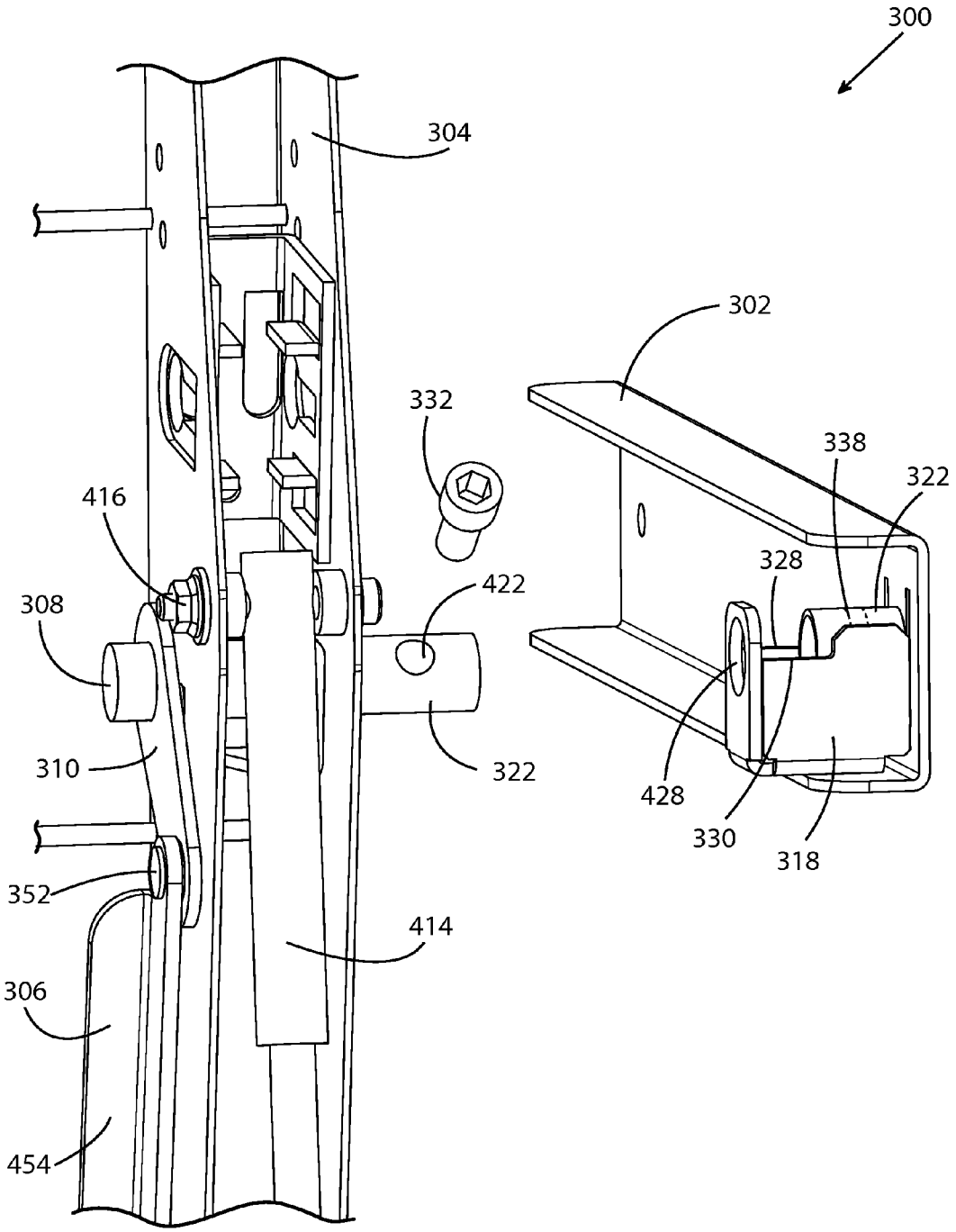
FIG. 8 is a rear perspective view of a self-leveling arm rest system that is installed on a seat frame.

FIG. 8 illustrates a rear perspective view of the linkage system 380 that illustrates the bolt 332 and dowel aperture 422 utilized therewith. Once the dowel is placed within the bracket aperture 428 and seated within the tube collar 322, the bolt 332 can be fixed in the dowel aperture 422 and tightened to a predetermined torque level. In an alternate embodiment, slot 338 is created within the tube collar 322 whereby the bolt 332 is fastened through the slot 338 and into the aperture 422 for securement of the dowel therein. The torque level of the bolt 332 securement can be commensurate with the amount of force required to rotate the arm channel 302 in space. Thus, a bracket 318 with a front stop 328 and a rear stop 330 can be employed with the bolt 332 disposed within the aperture 422 to define a range of motion for the arm channel 302. Alternatively, the bracket 318 is not used. Instead, a slot 338 is employed to define the range of motion of the arm channel 302 in space and force necessary for movement thereof. As a user pushes back on the rear frame 102, a piston 414 is engaged to slow displacement of the seat back frame 102. The piston 414 is fixably secured to the seat base frame 104 via a bracket 348 and pin 418 as shown.

Figure 9:
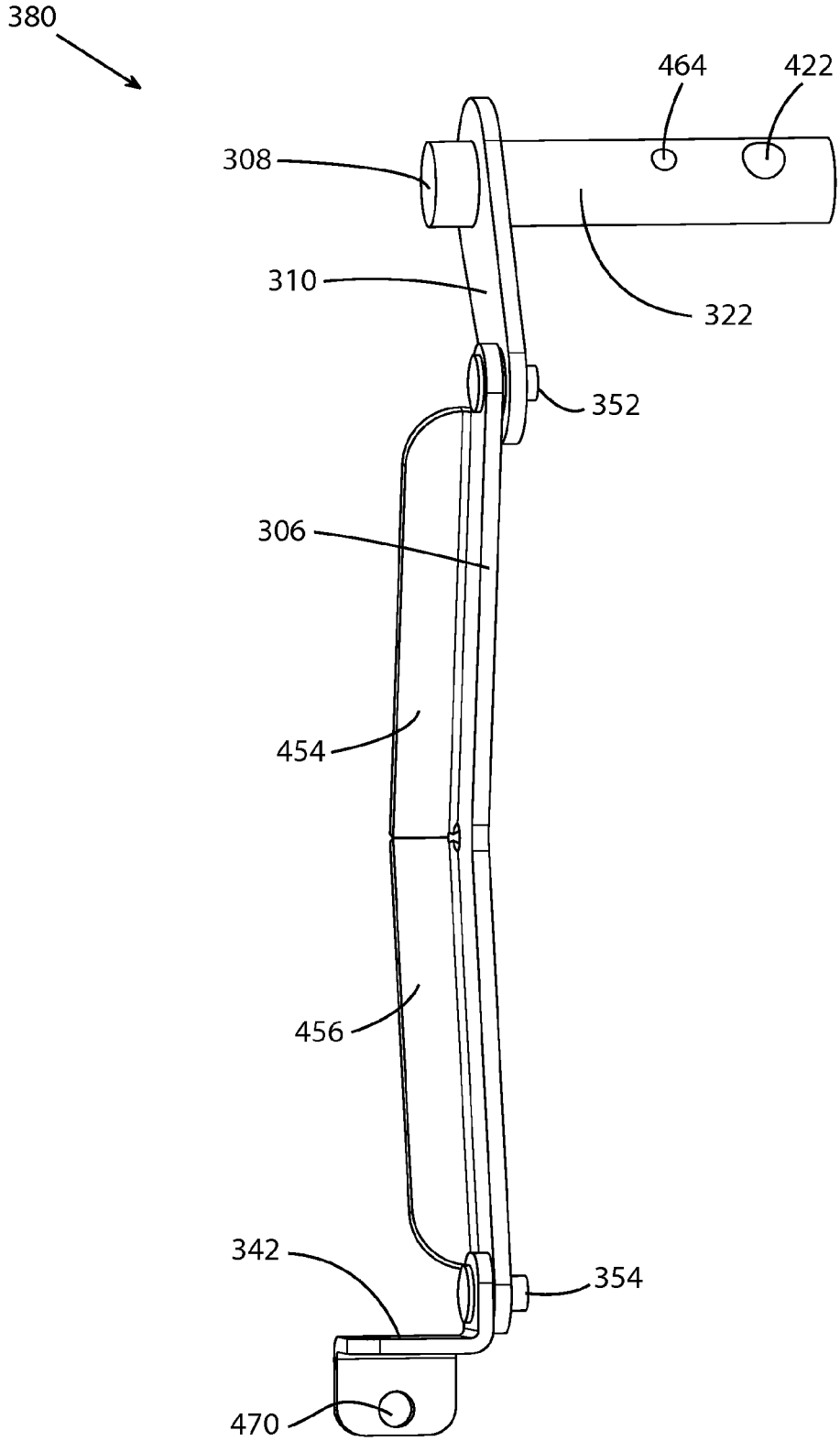
FIG. 9 is a perspective view of a linkage system used with a self-leveling arm rest system that is installed on a seat frame.
Figure 10:
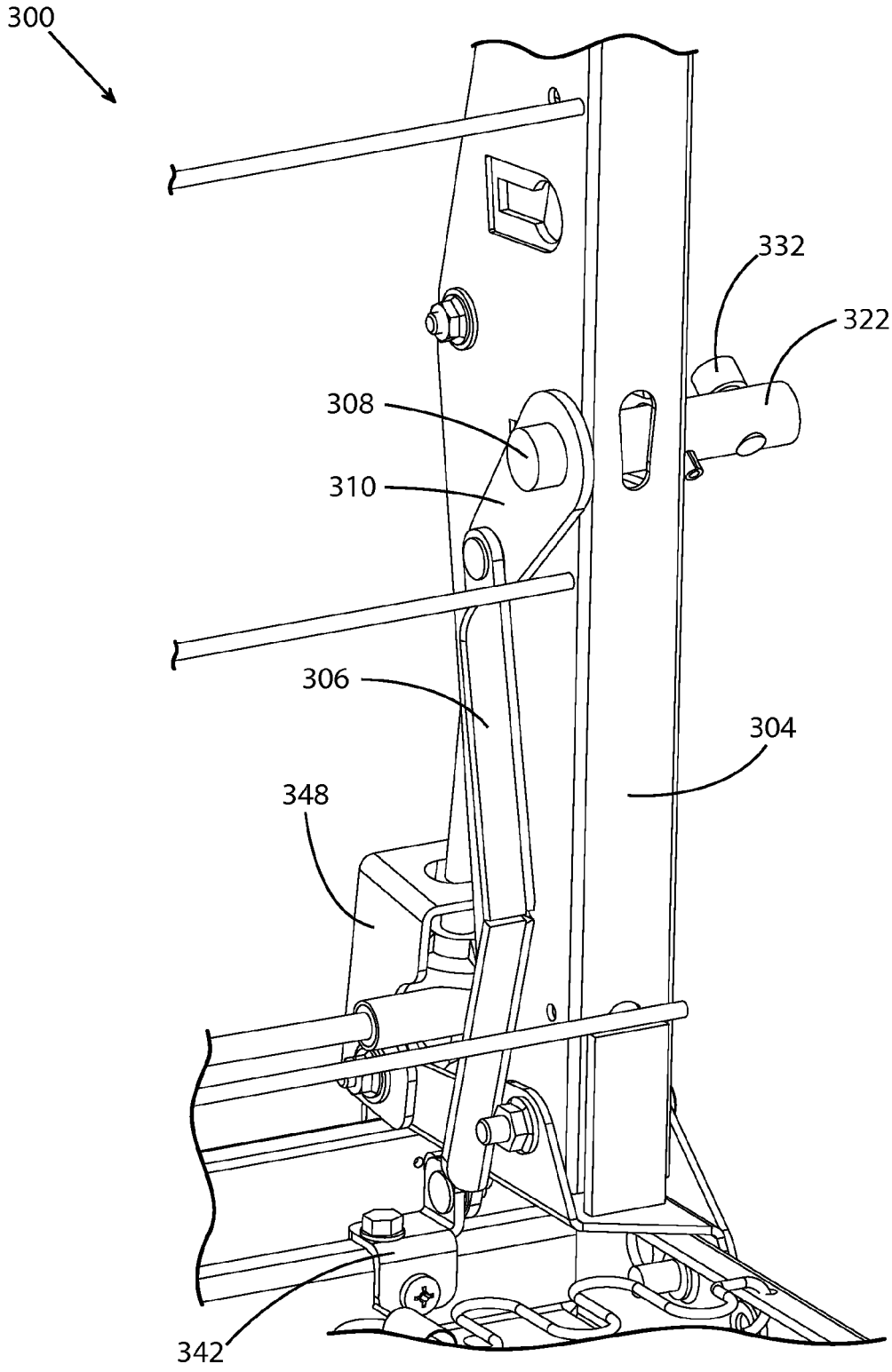
FIG. 10 is a rear perspective view of a self-leveling arm rest system that is installed on a seat frame.
Figure 11:
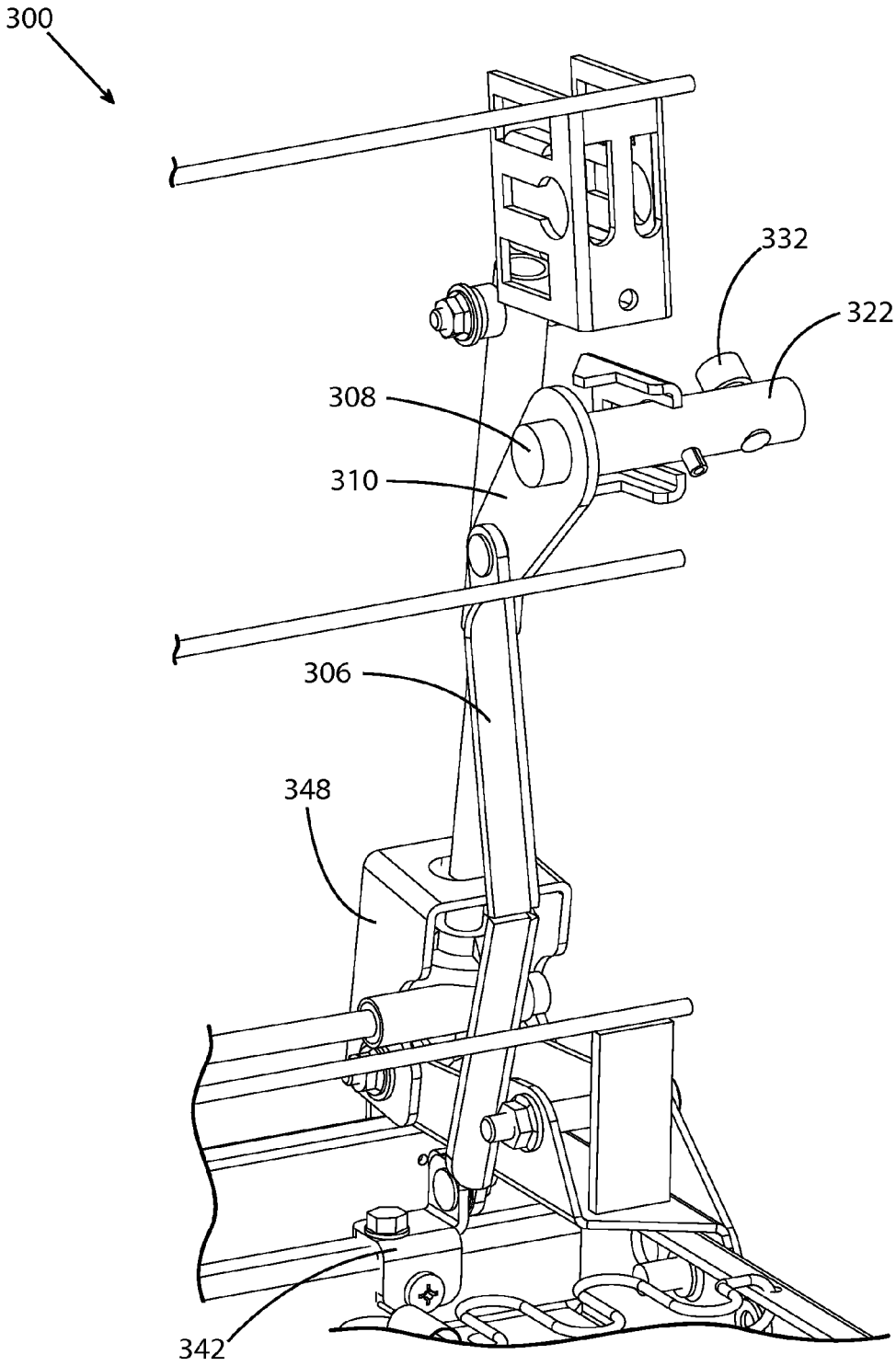
FIG. 11 is a rear perspective view of a self-leveling arm rest system that is installed on a seat frame.

FIG. 9 shows the linkage system 380 without the surrounding seat structure. In this illustration, the dowel 308 includes the dowel aperture 422 and a pin aperture 464 utilized to accommodate a role pin to prevent lateral movement of the linkage system relative to the rear frame 102. Also shown are a first fin 454 and a second fin 456 that extend from the rigid arm 306 to provide additional structural support. The bracket 342 is coupled to the linkage arm 306 via a fastening device 304. An aperture 470 is utilized to accommodate a fastening device to fixably secure the linkage system 380 to the base frame 104. FIGS. 10 and 11 show the linkage system within a seat frame wherein FIG. 10 illustrates the linkage system within the rear frame upright 304 and FIG. 11 shows a linkage system with the rear frame upright 304 removed to provide additional clarity to the subject embodiments.

The examples have been described with reference to the preferred embodiment. With reference to exemplarily embodiments. Obviously, modifications and alterations will occur to others upon reading and understanding the proceeding detailed description. It is intended that the exemplary embodiment be construed as including all such modifications and alterations insofar as they come within the scope of the appended claims where the equivalence thereof.

What is claimed is:

1. A self leveling arm system for a seat, comprising:

a dowel with a first end and a second end;

a pin extending perpendicularly from the first end of the dowel;

a cam that has a first end and a second end, the first end of the cam is fixedly secured to the second end of the dowel;

a main link that has a first end and a second end, the first end is rotatably secured to the cam;

a lower bracket rotatably secured to the second end of the main link and secured to a back frame member of a seat bottom frame, the seat bottom frame including two side frame members with the back frame member extending between the two side frame members; and a bracket including a keyhole for passage of the dowel and pin therein is mounted to a vertical support member of a seat back frame, the bracket securing the dowel to the seat back frame and the vertical support member pivotably connected to one of the side frame members of the seat bottom frame.

2. The system of claim 1, further including a tube collar, wherein the dowel is seated within the tube collar and wherein the dowel contains an aperture and the system further includes a bolt that is disposed within the aperture of the dowel to limit rotation of the dowel within the tube collar.

3. The system of claim 1, further including a tube collar, wherein the bracket is disposed substantially surrounding the tube collar, wherein the dowel extends through the bracket and is seated in the tube collar.

4. The system of claim 1, wherein the cam has a larger diameter on the first end that is secured to the dowel relative to the second end that is rotatably secured to the main link.

5. The system of claim 1, wherein the cam is rotatably secured to the main link via a rivet.

6. The system of claim 1, wherein the main link is angled at a point substantially near the center of the length of the main link.

7. The system of claim 1, further including a tube collar, wherein the dowel is seated within the tube collar and wherein the dowel contains an aperture and wherein the tube collar includes a slot to accept a bolt thereby securing the dowel through the aperture through the dowel aperture to the tube collar to facilitate rotation thereof.

8. The system of claim 7, wherein the slot is approximately 120 degrees around the circumference of the tube collar.

9. The system of claim 1, further including a tube collar, wherein the dowel is seated within the tube collar and wherein the tube collar is fixed to an arm channel.

10. The system of claim 1, wherein the dowel extends through the vertical support member.

11. A seat, comprising:

a seat back frame having a vertical support member;

a seat bottom frame having a back frame member and two side frame members with the back frame member extending between the two side frame members, where the vertical support member is pivotably connected to one of the side frame members of the seat bottom frame;

an arm channel that projects from the seat back frame toward a front plane of the seat, the arm channel is disposed and spaced at distance from the seat bottom frame;

a linkage system that couples the arm channel to the seat bottom frame, the linkage system includes:

a tube collar that is fixedly secured to the arm channel;

a dowel with a first end and a second end, the first end of the dowel is seated with the tube collar;

a pin extending perpendicularly from the first end of the dowel;

a cam that is fixedly secured to the second end of the dowel;

a main link that has a first end and a second end, the first end of the main link is rotatably secured to the cam;

a lower bracket rotatably secured to the second end of the main link and secured to the back frame member of the seat bottom frame, and a bracket including a keyhole for passage of the dowel and pin therein is mounted to the vertical support member of the seat back frame, the bracket securing the dowel to the seat back frame.

12. The system of claim 11, wherein the bracket substantially surrounds the tube collar, the keyhole in the bracket guiding the dowel to a seated position within the tube collar.

13. The system of claim 11, further comprising an aperture within the dowel that is located at a distance from the first end of the dowel that is greater than the height of the tube collar.

14. The system of claim 11, further comprising an aperture within the dowel, and further comprising a bolt that is disposed within the aperture to limit rotation of the dowel within the bracket.

15. The system of claim 11, wherein the tube collar includes a slot that is created at approximately 100 degrees.

16. The system of claim 11, further comprising a bolt which is disposed through a slot of the tube collar and an aperture of the dowel to limit rotation thereof.

17. The system of claim 11, wherein the main link is angled between the first end and the second end.

18. A seat, comprising:

a seat bottom having a back frame member and two side frame members with the back frame member extending between the two side frame members and a seat back having a vertical support member, where the vertical support member is connected to one of the side frame members, and wherein the seat back is pivotable with respect to the seat bottom about one or more pivots;

a linkage assembly including a main link that is coupled to the back frame member at one or more pivots, mounted to the vertical support member the seat back;

a cam is coupled to the main link opposite the lower bracket, wherein a dowel is permanently affixed to the cam and secured to the seat back by the bracket; and a pin extends perpendicularly from the dowel at an end distal from the cam;

wherein the bracket includes a keyhole for passage of the dowel and pin therein.

19. A seat back frame, comprising:

a tube collar;

a dowel with a first end and a second end, the first end is seated within the tube collar;

a pin extending perpendicularly from the first end of the dowel;

a cam that is fixedly secured to the second end of the dowel;

a vertical support member of a seat back attached to a side frame member of a base frame of the seat including two side frame members with the back frame member extending between the two side frame members;

a bracket attached to the vertical support member of the seat back including a keyhole disposed between the tube collar and the cam thereby accepting the dowel there thru, and securing the dowel to the seat back frame; and a main link coupled to the second end of the cam, a first end of main link is rotatably secured to the second end of the cam and a second end of the main link is rotatably secured to the back frame member of the base frame of this the seat by a lower bracket.

* * * * *

UNITED STATES PATENT AND TRADEMARK OFFICE

CERTIFICATE OF CORRECTION

PATENT NO. : 8,967,722 B2
APPLICATION NO. : 13/250091
DATED : March 3, 2015
INVENTOR(S) : Alan Neterer and Ron Dick It is certified that error appears in the above-identified patent and that said Letters Patent is hereby corrected as shown below:

In the claims

Claim 19, Col. 8, line 28: delete “this”.

Signed and Sealed this
Thirtieth Day of June, 2015

Michelle K. Lee

Michelle K. Lee
*Director of the United States Patent and Trademark Office*